US006618571B2

(12) United States Patent
Bartscher et al.

(10) Patent No.: US 6,618,571 B2
(45) Date of Patent: Sep. 9, 2003

(54) PROCESS AND DEVICE FOR TRANSFERRING TONER

(75) Inventors: Gerhard Bartscher, Köln (DE); Udo Dräger, Speyer (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/162,967

(22) Filed: Jun. 5, 2002

(65) Prior Publication Data

US 2003/0002893 A1 Jan. 2, 2003

(30) Foreign Application Priority Data

Jun. 29, 2001 (DE) ..... 101 31 652

(51) Int. Cl.[7] ..... G03G 15/16
(52) U.S. Cl. ..... 399/310; 399/311; 399/314
(58) Field of Search ..... 399/310, 311, 399/314, 66

(56) References Cited

U.S. PATENT DOCUMENTS

| | | | | |
|---|---|---|---|---|
| 4,797,335 A | * | 1/1989 | Hiratsuka et al. | 399/314 |
| 5,168,313 A | * | 12/1992 | Hosaka et al. | 399/314 |
| 5,287,144 A | * | 2/1994 | Takeda | 399/66 |
| 5,408,300 A | | 4/1995 | Wataki et al. | 355/276 |
| 5,689,758 A | | 11/1997 | Wataki et al. | 399/45 |
| 5,713,063 A | * | 1/1998 | Oono | 399/66 |
| 5,758,226 A | * | 5/1998 | Motohashi | 399/66 |
| 5,884,134 A | | 3/1999 | Karashima et al. | 399/316 |
| 6,101,361 A | | 8/2000 | Karashima et al. | |

FOREIGN PATENT DOCUMENTS

| | | | |
|---|---|---|---|
| DE | 197 03 255 C 2 | 7/1997 | G03G/15/16 |
| DE | 197 26 098 A1 | 2/1998 | G03G/15/16 |
| EP | 0 339 673 | 11/1989 | G03G/15/16 |
| EP | 0 537 793 A2 | 4/1993 | G03G/15/16 |
| JP | 96148954 A | 5/1994 | G03G/13/16 |
| JP | 06222692 A | 8/1994 | G03G/15/16 |

* cited by examiner

*Primary Examiner*—Susan S. Y. Lee
*Assistant Examiner*—Candice C. Campbell
(74) *Attorney, Agent, or Firm*—Lawrence P. Kessler

(57) ABSTRACT

Toner material is transferred from a locally charged imaging member to a printed material with a d.c. voltage applied onto an a.c. voltage having voltage peaks in the range of 6–8 kV with a duration of 0.5–1.5 μsec combined with it.

4 Claims, 2 Drawing Sheets

PROCESS AND DEVICE FOR TRANSFERRING TONER

FIELD OF THE INVENTION

The invention involves a device for transferring toner from imaging members or photoconductors.

BACKGROUND OF THE INVENTION

In electrophotography and other imaging technologies, toner or toner material is transferred from a locally charged imaging member or photoconductor drum to the printed material. The term imaging member is understood to be any type of medium from which toner is transferred to a final printed material, for example, an imaging drum. The efficiency of the toner material transfer is, for the exclusive application of pressure on the printed material without additional arrangements, approximately 80%, i.e. 80% of the toner material that is adhering to the imaging member due to electrostatic forces is rolled off onto the printed material.

In the prior art, in order to increase the toner material transfer, a static d.c. voltage has been applied in the area between the printed material and the imaging member, which, in addition to the transfer of the toner material through mechanical pressure, exerts electric forces on the electrically charged toner material and increases the portion of the toner material that adheres to the printed material. Problematic in the application of a suitably strong static electric field is the danger of electric arc-over and breakdown of the static electric field, so that the size of the static electric field is limited.

Using the measure of a static electric field, approximately 90% of the toner material originally located on the imaging member prior to roll-off is removed from the imaging member. The remaining portion of approximately 10% of the toner material represents a disturbance for the subsequent imaging of the imaging member and is thus undesirable. The remaining toner material is removed in a different manner, either using a brush that acts upon the imaging member or a vacuum evacuation device. The material expense and cost for these measures for removing toner material is considerable.

SUMMARY OF THE INVENTION

Accordingly, the purpose of this invention is to improve the effective transfer of toner material from an imaging member to the printed material. This is achieved using a process and a device for transferring toner from an imaging member to printed material using a d.c. voltage in the area between the imaging member and the printed material, whereby the d.c. voltage is at least temporarily combined with a transient (ripple) a.c. voltage. By this characteristic the efficiency of the transfer of toner material is improved considerably.

The invention and its advantages will be better understood from the ensuing detailed description of preferred embodiments, reference being made to the accompanying drawings in which like reference characters denote like parts.

BRIEF DESCRIPTION OF THE DRAWINGS

In the following, two drawings are provided in connection with a description for closer explanation of an example of the invention.

DETAILED DESCRIPTION OF THE INVENTION

Figure 1:
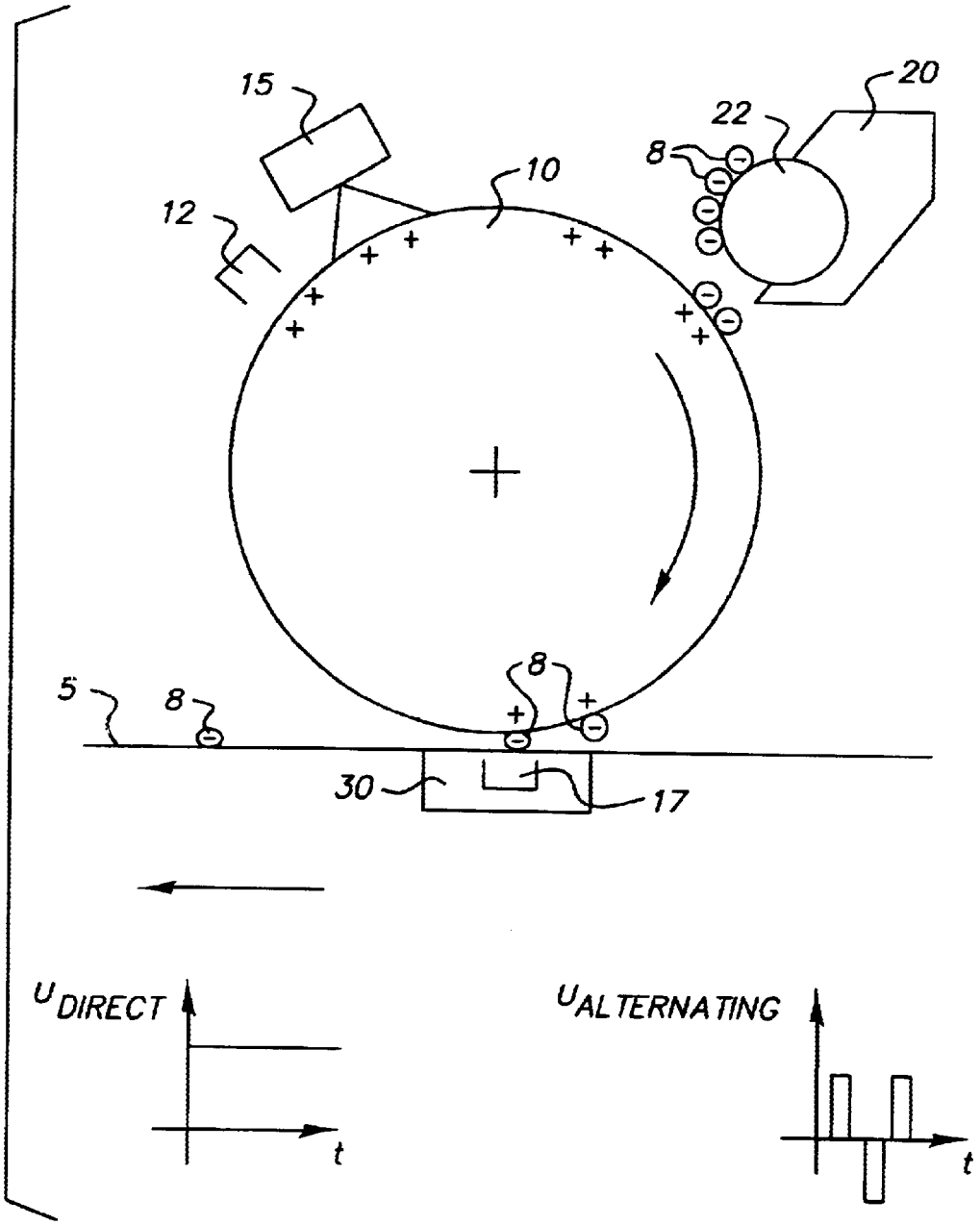
FIG. 1 shows an electrophotographic imaging unit with a device, according to this invention, for transferring toner to a printed material.

FIG. 1 shows the principle of an electrophotographic imaging device including image transfer according to this invention. The imaging member 10 with a suitable photoconductive surface is positively charged uniformly via a charge corotron 12 as a source of electric charges and provided with a latent image via a controlled light source 15. The positive charges from the charge corotron 12 on the photoconductive surface of the imaging member 10 are schematically identified with plus signs. The controlled light source 15 can emit light from an LED field or scanning laser light. The positioning of light pulses of the light source 15 onto the imaging member 10 corresponds to the final printed image on a printed material 5. By the illumination with the controlled light source 15, the charge that is uniformly distributed on the surface of the imaging member 10 is partially discharged. The exposure with light by the light source 15 is depicted in the Figure by two straight lines that part from each other in the direction of the imaging member 10.

By turning the imaging member 10 in the direction of the curved arrow, the latent image moves in the direction of a developing unit 20, which causes an inking of the latent image. Part of the developing unit 20 is an ink drum 22, which turns at a certain speed with the imaging member 10. The ink drum 22 carries the toner material 8, which is indicated in the Figures by small circles that have a minus sign drawn in them. This means that the toner material 8 carries negative electric charges that are attracted because of the electric forces of attraction between different polarities by the positive charges of the charge corotron 12 to the surface of the imaging member 10. The negatively charged toner material 8 adheres with small forces on the ink drum 22 and easily detaches from it, in order to accumulate on the positively charged positions of the latent image on the imaging member 10, as shown in FIG. 1. The latent image, which is produced by the light source 15, is then inked with negatively charged toner material 8, and the developed image is located on the surface of the rotating imaging member 10.

The electrophotographic imaging device contains a transfer corotron 17 beneath the printed material 5, which provides a d.c. voltage $U_{DIRECT}$ in the area between the imaging member 10 and the printed material 5. Further, a back-up device 30 is provided which counteracts pressure of the member 10 on the printer material 5. The mechanical pressure from the reaction with the device 30 contributes to the toner material 8 being transferred onto the printed material 5, for the most part at a certain speed, which is adjusted to the imaging member 10. The transfer corotron 17 is charged in such a way that a certain difference in potential exists between the device 30 and the surface of the imaging member 10. The d.c. voltage $U_{DIRECT}$ is depicted schematically in a graphical diagram next to the device 30. Using the transfer corotron 17 and the mechanical pressure, an approximately 90% portion of the toner material 8 is transferred onto the printed material 5.

The rest of the toner material 8, however, remains adhering, without additional measures, on the imaging member 10 and is transported further. In order to prevent incorrect inkings and finally errors in the printed image, the rest of the toner material 8 must essentially be removed before a new imaging of the imaging member 10. An increase in the d.c. voltage $U_{DIRECT}$ is ruled out as a possible solution, since through it, there is the danger of a voltage arc-over. Therefore, the device 30 includes an a.c. voltage source, which provides, at least periodically, an a.c. voltage $U_{ALTERNATING}$ between the surface of the imaging member 10 and the device 30. The a.c. voltage $U_{ALTERNATING}$ is depicted schematically next to the device 30 in another graphical diagram. The applied a.c. voltage $U_{ALTERNATING}$ includes pulses in the amplitude range of approximately 5 kV, with an amplitude duration of approximately 1 ms, and causes a large portion of the toner remnants of the toner material 8, which cannot be removed using the d.c. voltage $U_{DIRECT}$ and the mechanical pressure, to be removed from the surface of the imaging member 10.

The a.c. voltage $U_{ALTERNATING}$ causes the result that if a potential increase is present between the imaging member 10 and the printed material 5 in a first polarization of the a.c. voltage $U_{ALTERNATING}$, particles of the toner material 8 migrate back from the printed material 5 to the imaging member 10. In the area with a minimum distance between the printed material 5 and the device 30, the migrating particles of the toner material 8 meet the particles of the toner material 8 that are still adhering to the imaging member 10 and they knock these free, whereby the freed particles of the toner material 8 can migrate to the printed material 5 under the influence of the d.c. voltage field $U_{DIRECT}$ and the now repolarized a.c. voltage field $U_{ALTERNATING}$. The result of the combination of the d.c. voltage $U_{DIRECT}$ and the a.c. voltage $U_{ALTERNATING}$ is a significant improvement of the removal of toner remnants of toner material 8 from the surface of the imaging member 10 and the appropriate transfer to the printed material 5.

Figure 2:
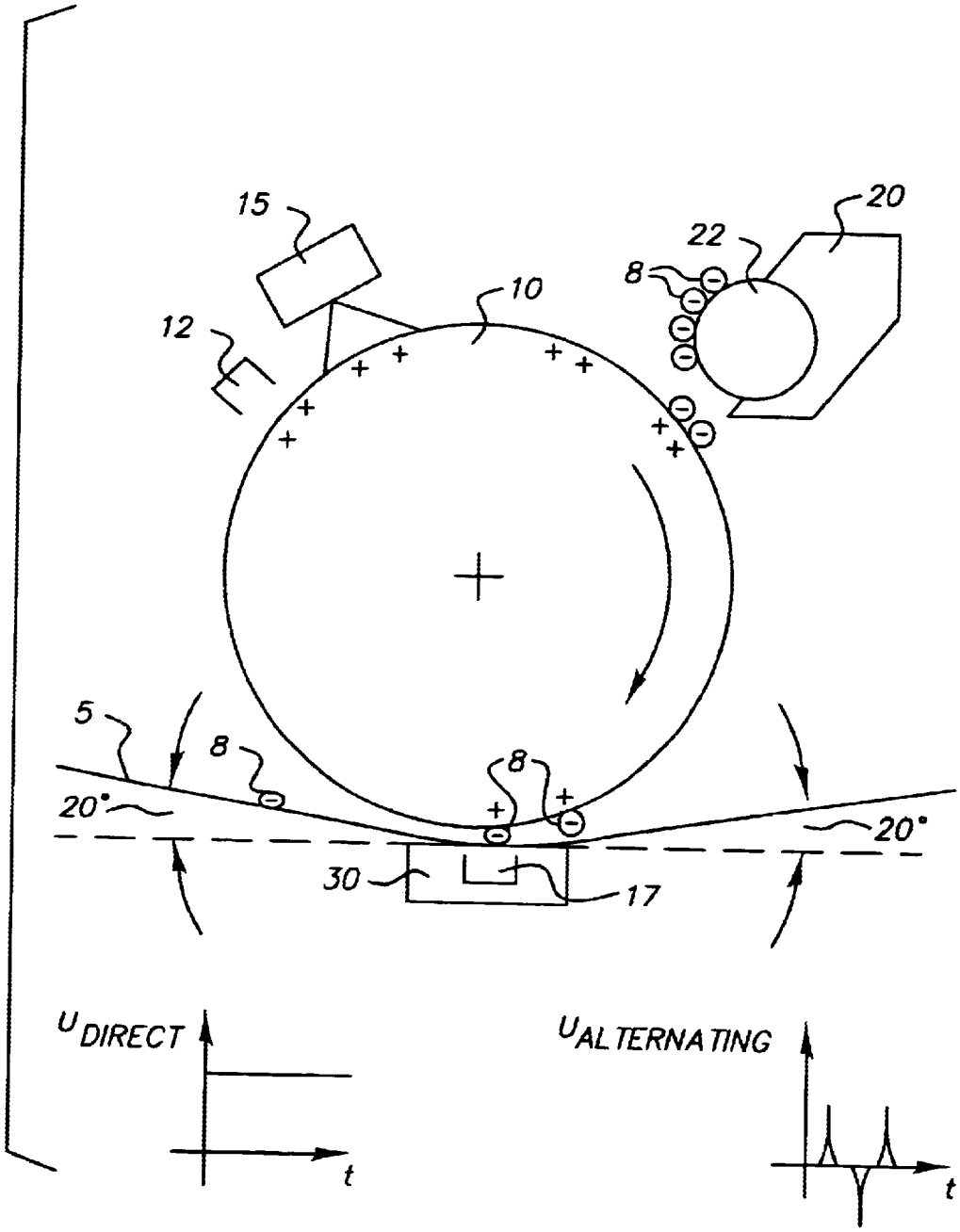
FIG. 2 shows a variation of the imaging unit according to FIG. 1, in which the printed material is rolled around the imaging member.

FIG. 2 shows a variation of the embodiment form of the invention according to FIG. 1, in which the printed material 5 is rolled around a section of the imaging member 10 with the photoconductor. The a.c. voltage field with the a.c. voltage $U_{ALTERNATING}$ of the device 30 acts only if the air gap between the imaging member 10 and the printed material 5 is almost closed. Otherwise, image artifacts can occur on the printed material 5. The applied a.c. voltage $U_{ALTERNATING}$ results, for this embodiment form, from peaks, i.e. short steep voltage pulses.

In order to increase the area between the printed material 5 and the imaging member 10, in which the air gap is almost closed or at a minimum size, and to increase the efficiency of the device, the printed material 5 is conducted past the imaging member not in a planar manner, but bent in the direction of the imaging member 10. The bending angle of the printed material 5 around the imaging member 10 is approximately 20° on each side. The function of the device 30 is identical to the one described under FIG. 1.

Of course, in other variations of transfer with the device 30, according to this invention, the toner material 8 is first transferred onto an intermediate substrate, a cylinder with a rubber-like soft-elastic surface or a rubber blanket, and then transferred onto the printed material 5.

The invention has been described in detail with particular reference to certain preferred embodiments thereof, but it will be understood that variations and modifications can be effected within the spirit and scope of the invention.

What is claimed is:

1. Process for transferring toner (8) from an imaging member (10) or photoconductor onto printed material (5) by applying a d.c. voltage in the area between said imaging member (10) and said printed material (5), and combining with said d.c. voltage, at least periodically, an a.c. voltage having voltage peaks with an amplitude in the range of 6–8 kV and a duration in the range of 0.5–1.5 $\mu$sec.

2. Process for transferring toner (8) according to claim 1, whereby said a.c. voltage acts exclusively between said printed material (5) and a back-up device (30).

3. Process for transferring toner (8) according to claim 1, whereby said printed material (5) extends at an angle of substantially 20° in relation to said imaging member (10).

4. Device (30) for transferring toner (8) from an imaging member (10) or photoconductor onto printed material (5) comprising: a source for a d.c. voltage in the area between the imaging member (10) and the printed material (5), and an additional source for an a.c. voltage provided, at least periodically, between said printed material and a back-up device, said a.c. voltage having voltage peaks with an amplitude in the range of 6–8 kV and a duration in the range of 0.5–1.5 $\mu$sec.

* * * * *